United States Patent [19]

Mulvey

[11] 4,161,019

[45] Jul. 10, 1979

[54] LIGHTING FIXTURE

[76] Inventor: Gerard E. Mulvey, 57 Mobile Dr., Toronto, Ontario, Canada

[21] Appl. No.: 793,132

[22] Filed: May 2, 1977

[30] Foreign Application Priority Data

Feb. 25, 1977 [CA] Canada ..... 272726

[51] Int. Cl.[2] ..... F21V 21/34; F21V 21/14

[52] U.S. Cl. ..... 362/147; 362/148; 362/149; 362/220; 362/260; 362/365; 362/371; 362/391; 362/406

[58] Field of Search ..... 362/147, 148, 220, 260, 362/365, 371, 391, 406, 149

[56] References Cited

U.S. PATENT DOCUMENTS

| | | | |
|---|---|---|---|
| 3,720,432 | 3/1973 | Chudler | 362/365 X |
| 3,755,667 | 8/1973 | Price | 362/147 |

FOREIGN PATENT DOCUMENTS

| | | | |
|---|---|---|---|
| 862936 | 3/1961 | United Kingdom | 362/365 |

*Primary Examiner*—Richard D. Lovering

[57] ABSTRACT

A lighting fixture is removably supported within a coffer of a modular suspended ceiling structure by two arms which are retractably mounted at each end of the fixture for movement between extended positions in which they are supported on the top surface of the surrounding ceiling structure and retracted positions to permit vertical lowering or upward insertion of the fixture into the ceiling.

13 Claims, 14 Drawing Figures

LIGHTING FIXTURE

BACKGROUND OF THE INVENTION

The present invention relates to ceiling structures and more particularly to ceiling structures of the known suspended type. Even more particularly, this invention relates to the installation of lighting and other electrically powered fixtures in a ceiling structure. While this invention is particularly applicable to the installation of electrically powered fixtures such as lighting fixtures in any ceiling structure, it is particularly applicable to the installation or mounting of such fixtures in suspended ceiling structures of the so-called coffered type. This invention also embraces certain novel electrically powered fixtures and particularly lighting fixtures for use in ceiling structures.

In the known systems for installing lighting fixtures in suspended ceiling structures, it is customary to secure such fixtures in position by means of screws or other fastening devices and to connect such fixtures to a suitable source of electrical power above the ceiling. While this known procedure presents only marginal problems in simple planar ceiling structures, it presents a more serious problem in the case of known ceiling structures of the coffered type. For example, if it is necessary to repair, remove or replace a lighting fixture installed in such a ceiling as known, it is generally necessary to disconnect the lighting fixture from the ceiling structure and then to disconnect it from the source of electrical power.

This is not only time-consuming but it is also relatively expensive.

It is accordingly a principal object of this invention to provide a ceiling structure having a lighting or other electrically powered fixture mounted therein and from which a fixture is easily removed.

It is another object of this invention to provide an improved electrically powered fixture and particularly a lighting fixture for use in a ceiling structure.

Other objects of the invention will become apparent as the description herein proceeds.

SUMMARY OF THE INVENTION

Broadly, the present invention provides a ceiling structure including mutually parallel and spaced apart ceiling members having upwardly facing surfaces and an electrically powered fixture removably positioned between such ceiling members and supported in such position by arms retractably mounted on said fixture for movement between extended positions for disposition on said upwardly facing surfaces of said ceiling members and retracted positions so that said fixture can then be moved vertically between said ceiling members.

While the invention is especially applicable to the removable mounting of any electrically powered fixture in a ceiling structure, it is especially applicable to the removable mounting of electrically powered lighting fixtures.

The teaching of this invention is, as already indicated, particularly applicable to the removable mounting of lighting fixtures in a suspended ceiling structure of the so-called coffered type and especially in a suspended coffered-type ceiling structure as described in my patent application entitled "MODULAR CEILING STRUCTURE" Ser. No. 793,133, filed May 2, 1977. Such a suspended ceiling structure, in a preferred embodiment thereof, comprises a plurality of individual ceiling modules, each defined by outer edges and each individually suspended from above and interconnected along their outer edges so as then to be disposed in a common ceiling plane, each such module being in the form of a downwardly open box-like structure defined by side walls and a top wall, and such lighting fixture being removably mounted within such a box-like structure.

Other features of the invention and the advantages presented thereby will become apparent as the description herein proceeds.

BRIEF DESCRIPTION OF THE DRAWINGS

The invention will now be described in greater detail but merely by way of illustration with reference to the accompanying drawings, in which.

DESCRIPTION OF THE PREFERRED EMBODIMENT

Figure 1:
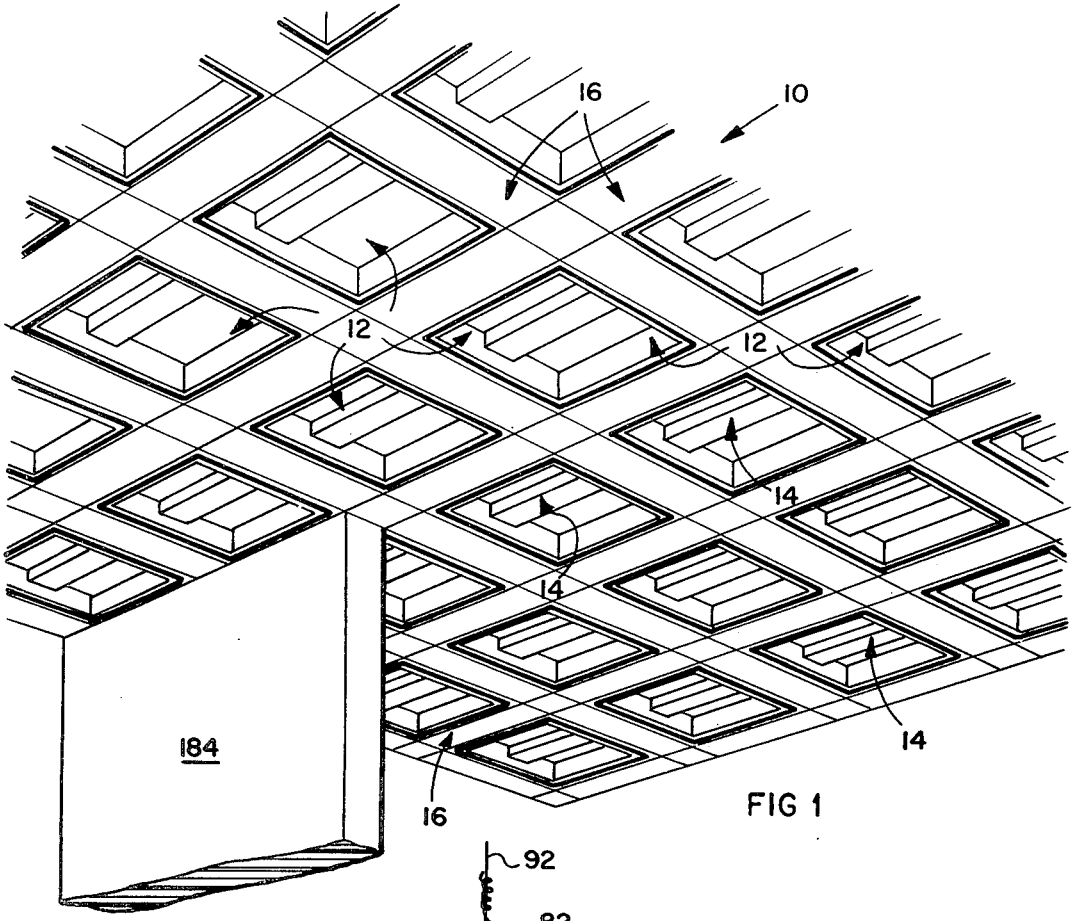
FIG. 1 is a fragmentary perspective view from below of one embodiment of a ceiling structure in accordance with the present invention.

Referring first to FIG. 1 of the accompanying drawings, it will be seen that there is generally indicated therein by the legend 10 a ceiling structure which is formed from a plurality of coffer or ceiling modules indicated generally by the legend 12 and each containing a lighting fixture generally indicated by the legend 14. Supported between the modules 12 in a manner yet to be explained are strips or panels generally indicated at 16.

Figure 2:
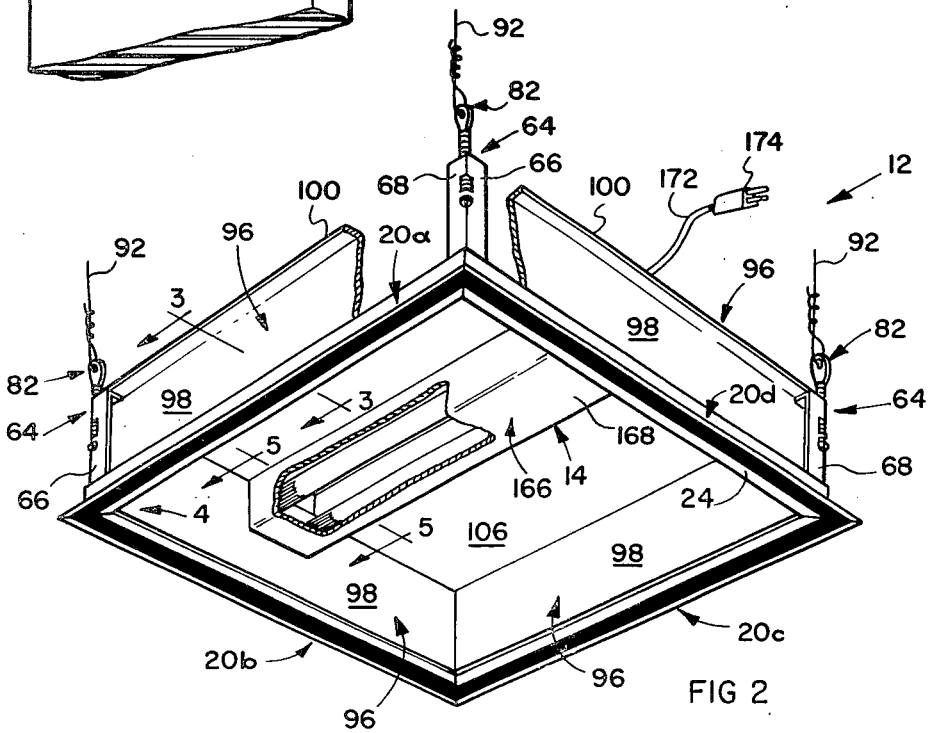
FIG. 2 is a fragmentary perspective view from below of a ceiling module as used in the ceiling structure shown in FIG. 1.
Figure 3:
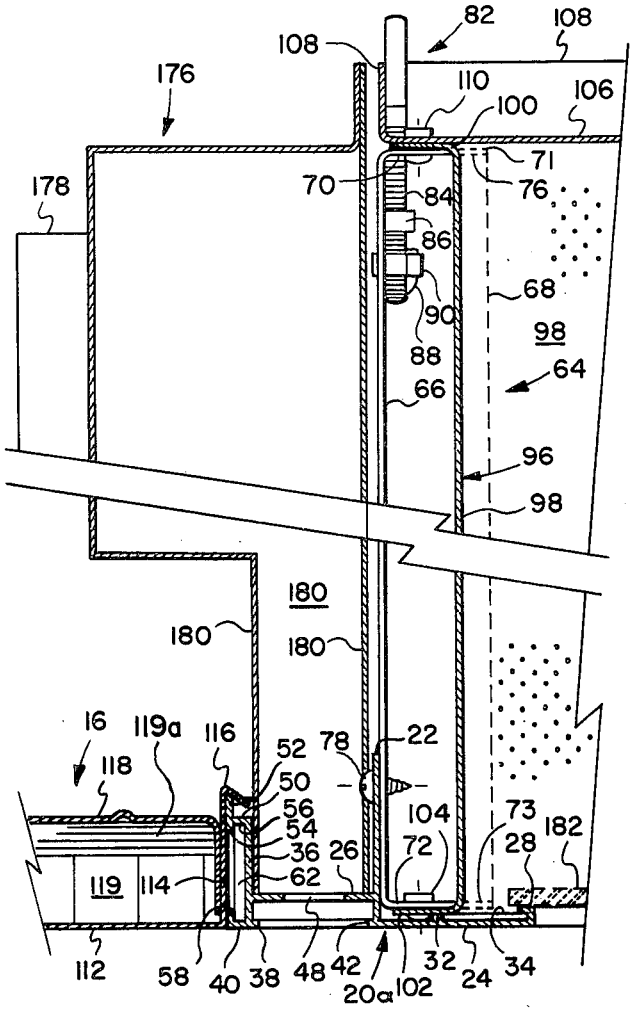
FIG. 3 is a vertical sectional view through the module shown in FIG. 2 when taken as indicated by the arrows 3—3 of that figure.
Figure 4:
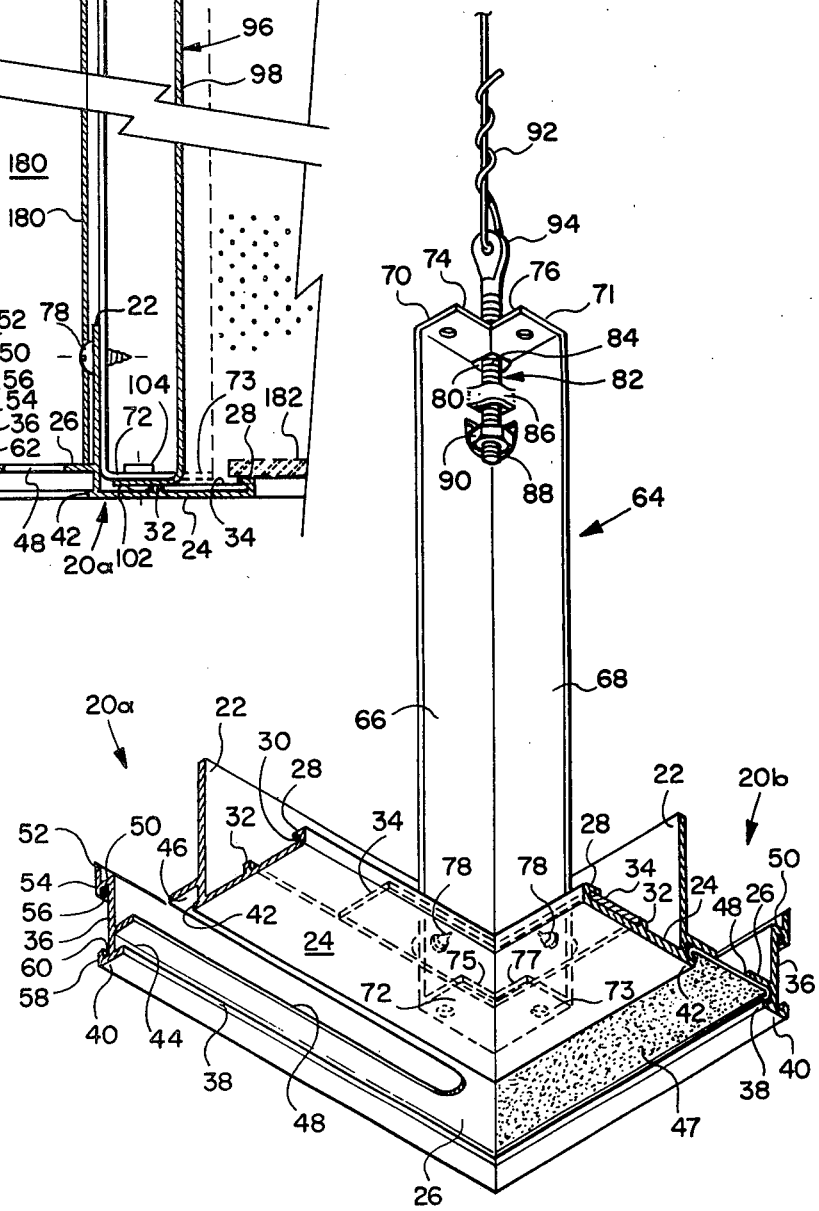
FIG. 4 is a fragmentary internal perspective view of a corner structure of the module shown in FIG. 2 when viewed generally as indicated by the arrow 4 of that figure and with certain parts omitted and others cut away.

Reference will now be made to FIGS. 2, 3 and 4 to describe the construction of the modules 12. While the module 12 is shown in FIG. 2 as having a square configuration in plan view, it should be understood that other rectangular plan configurations are possible. It is possible to provide and utilize modules having non-rectangular configurations.

The module 14 comprises, as shown in FIG. 2, a square frame formed from four identical extrusions generally indicated at 20*a*, 20*b*, 20*c* and 20*d*, the ends of which are mitred to interfit as is best shown in FIG. 4. Alternatively, those frame members can be made by roll forming.

Each of the extrusions 20*a*, 20*b*, 20*c* and 20*d* comprises an upstanding flange 22 which is integrally formed with an inwardly directed flange 24 and, at a slightly higher position, with an outwardly directed flange 26. At its inner edge, the inwardly directed flange 24 is formed with an outwardly directed lip 28 defining a recess 30 and, between that inner edge and the upstanding flange 22 with a longitudinally extending lip 32. For interconnecting the extrusions 20*a*, 20*b*, 20*c* and 20*d*, flat L-shaped corner pieces 34 (FIG. 4) are positioned with a respective leg on the flange 24 and with one of the longitudinal edges of such leg abutting the lip 32 and the other longitudinal edge of such leg received in the recess 30.

At its outer edge, the outwardly directed flange 26 is integrally formed with an upstanding flange 36 which, along its lower edge, is formed with an inwardly directed lip 38 and an outwardly directed lip 40, the lips 38 and 40 being essentially coplanar with the aforementioned inwardly directed flange 24. A similarly coplanar outwardly directed lip 42 is formed along the bottom edge of the upstanding flange 22, the lip 42 being spaced from the opposed lip 38 as best shown in FIG. 3 and the lips 38 and 42 downwardly defining elongated recesses 44 and 46 respectively.

Elongated openings 48 are formed in the outwardly directed flanges 26 of the frame extrusions 20*a*, 20*b*, 20*c* and 20*d* for the supply of air to the space beneath the ceiling structure 10 or for the removal of air from that space in a manner which will be described in greater detail hereinafter. In the event that it is not required to use such openings 48 for such air flow purposes, such openings can be concealed by an elongated decorative strip 47 which usefully has turned over side edges which are slidingly received in or snapped into the recesses 44 and 46 as shown for the extrusion 20*b* in FIG. 4.

Along its top edge, the aforementioned upstanding flange 36 is formed with an outwardly projecting lip 50 which is itself formed with upwardly and downwardly projecting lips 52 and 54 respectively, the latter defining, with the flange 36, a downwardly open recess 56. An upstanding lip 58 is formed on the outer edge of the lip 40 to define an opposed and upwardly open recess 60, one leg of an L-shaped corner piece 62 (FIG. 3) being inserted with its side edges received in the recesses 56 and 60.

The module 12 also comprises four upstanding corner posts generally indicated at 64, three of which are visible in FIG. 2 and which are formed from lengths of angle iron having flanges 66 and 68. At the upper end, the flanges 66 and 68 of each corner post 64 are folded over at 70 and 71 respectively and mitred to provide horizontal end pieces. Similarly, the lower ends of the flanges 66 and 68 are folded over as indicated at 72 and 73 respectively. These folded over portions 70, 71, 72 and 73 are notched to provide upper and lower edges 74 and 75 respectively parallel to the flange 66 and upper and lower edges 76 and 77 respectively parallel to the flange 68.

The corner posts 64 are secured to adjacent ones of the frame extrusions 20*a*, 20*b*, 20*c* and 20*d* by self-tapping screws 78 passing inwardly through the upstanding flanges 22 of those extrusions and through respective ones of the flanges 66 and 68 of those corner posts.

At its upper end, each of the corner posts 64 is formed in its folded over portions 70 and 72 and at the junction between the flanges 66 and 68 with an opening 80 for freely receiving a vertical and threaded eye-bolt generally indicated at 82, the shaft 84 of which extends through the opening 80, behind a strap 86 stamped from the flanges 66 and 68. A further opening 88 is cut in the flanges 66 and 68 to receive a nut 90 screwed onto the shaft 84 of the eye-bolt 82. A hanger wire 92 (omitted from FIG. 3) suitably anchored at its upper end (not shown) above the ceiling is fastened to an eye 94 of the eye-bolt 82.

It will not be understood that, by turning the nut 90 on the shaft 84 of the eye-bolt 82, the vertical position of the respective corner of the module 12 can be adjusted.

Each of the modules 12 also comprises four side walls generally indicated at 96 (omitted from FIG. 4) and formed from sheet metal so as to have an upstanding wall portion 98 and outwardly directed upper and lower flanges 100 and 102 respectively.

The lower flanges 102 of the side walls 96 are received below the folded over portions 72 and 73 of respective ones of the corner posts 64 with the wall portion 98 abutting a respective one of the edge surfaces 75 and 77. Rivets 104 secure the lower flanges 102 of the lower folded over portions of the corner posts.

The upper flanges 100 of the side walls 96 are disposed over the respective ones of the folded over portions 70 and 71 at the upper ends of the corner posts 64 so that the wall portions 98 abut respective ones of the edge surfaces 74 and 76. Optionally, the wall portions 98 of the side walls 96 are perforated as shown in FIG. 3 and batts (not shown) of a sound-absorbing material such as glass fibre are provided outwardly of the wall portions 98.

The module 12 also comprises a top wall 106 which is formed with upstanding peripheral flanges 108. The top wall 106 is secured to the side walls 96 and to the corner posts 64 by rivets 110 extending through that top wall 106, a respective one of the upper flanges 100 of the side wall, and a respective one of the upper folded over portions 70 and 71 of the corner post 64. Batts of sound-absorbing material are usefully provided on top of the top walls 106 of the modules 12.

As already indicated, the ceiling structure 10 also comprises strips or panels 16 which are secured to adjacent modules 12 to bridge the gaps therebetween. One such panel is shown fragmentarily in FIG. 3 as being formed from a piece of sheet metal folded so as to provide a lower panel 112 and side walls 114 integrally formed at their upper ends with downwardly projecting lips 116 which are supportingly received over and along the top edges of the aforementioned lips 52 on the extrusions forming the module frame. The panel 16 is also shown in FIG. 3 as being provided with an upper panel 118 spaced apart upwardly of the lower panel 112 to provide a compartment containing a honey comb system of sound entrappment chambers 119, and batts 119*a* lying thereon.

Figure 5:
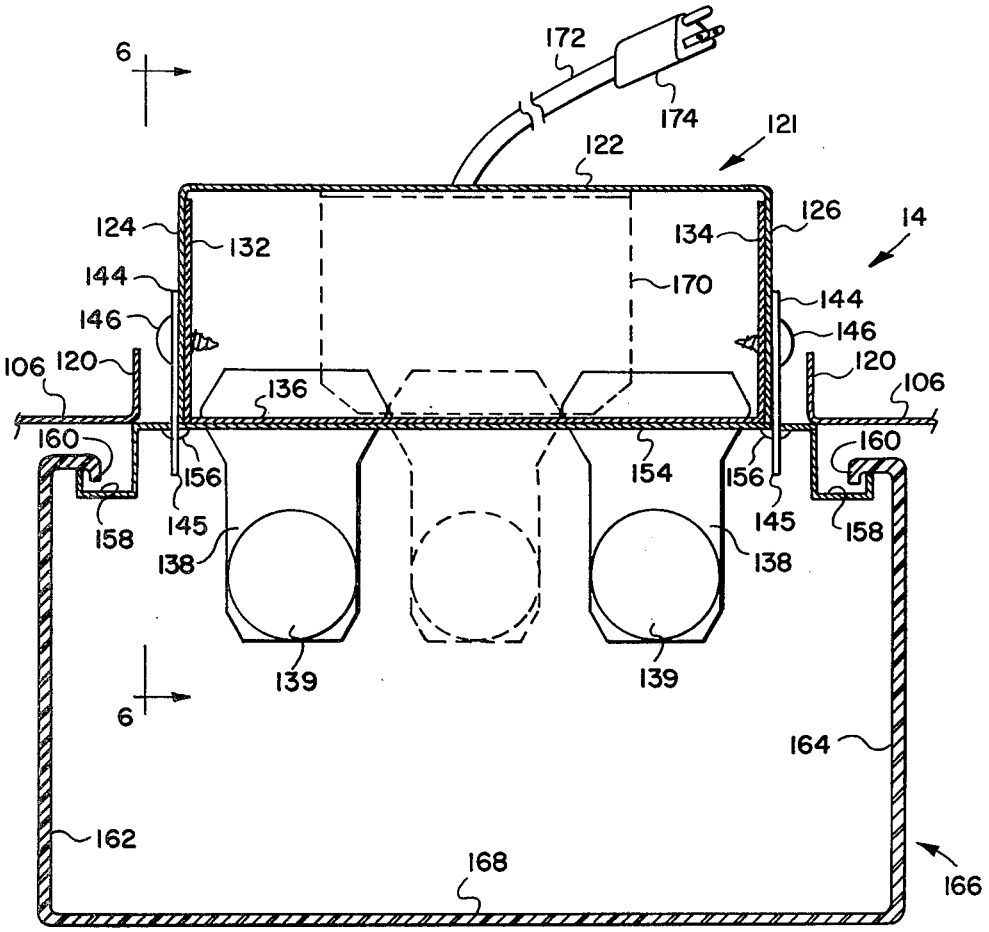
FIG. 5 is a vertical sectional view through the module shown in FIG. 2 when taken as indicated by the arrows 5—5 in that figure.
Figure 6:
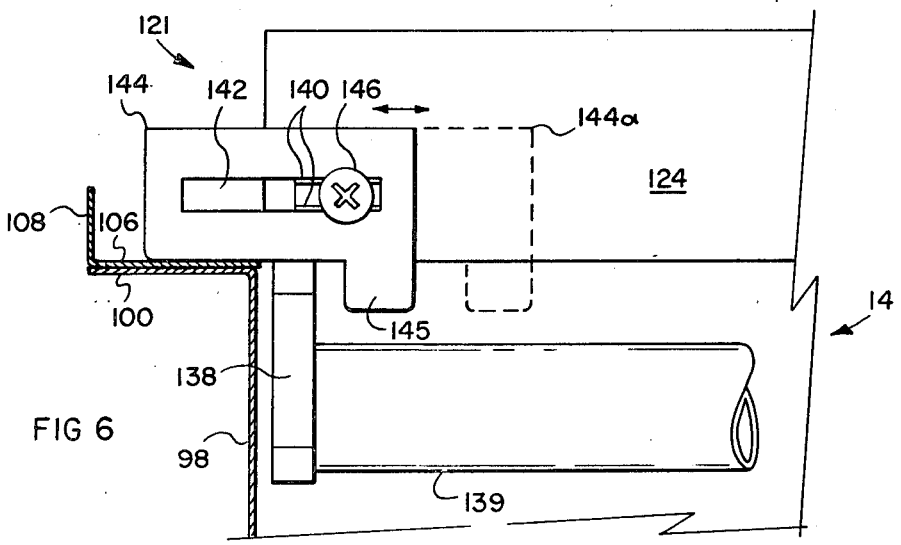
FIG. 6 is a fragmentary vertical sectional view through the module shown in the preceding figures, when taken as indicated by the arrows 6—6 in FIG. 5, and showing details of one system in accordance with this invention for removably supporting a lighting fixture in a ceiling structure.
Figure 7:
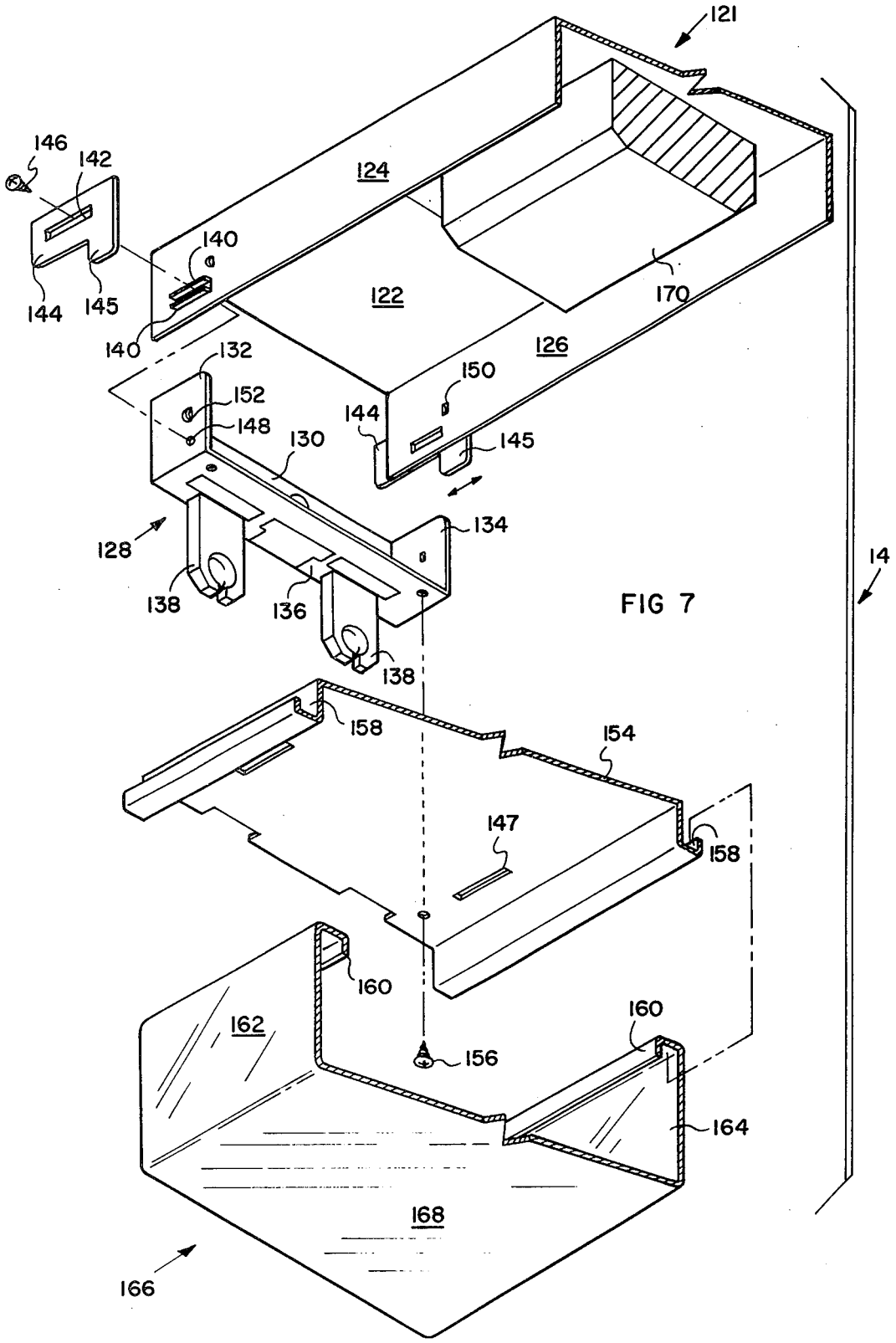
FIG. 7 is a fragmentary, exploded perspective view showing further details of the construction of the lighting fixture shown in the preceding figures.

Reference will now be made to FIGS. 5, 6 and 7 of the accompanying drawings to describe the construction of one of the lighting fixtures 14 and the manner in which that fixture is mounted in an opening provided in the top wall 106 of one of the modules 12. About such an opening, the top wall 106 is deformed to provide an upstanding flange 120 (FIG. 5).

The lighting fixture 14 comprises an upper housing generally indicated at 121 formed from a piece of sheet metal so as to have a top plate 122 and depending side walls 124 and 126. The fixture 14 also comprises two end closures, one of which is shown generally at 128 in FIG. 7 and which is formed by folding a piece of sheet metal to provide an end wall 130, side pieces 132 and 134 and an end base plate 136 on which there can be mounted in a conventional manner one, two or three sockets 138 of a known type for receiving the ends of a fluorescent tube 139.

For a reason yet to be explained, the side walls 124 of the upper housing 121 are each formed near both their ends with outwardly stamped and mutually spaced apart resilient flanges 140 which are slidingly but frictionally received in elongated slots 142 formed in arms 144, also formed with depending handle portions 145. Self-tapping screws 146 extend through the slots 142 in the arms 144, between the flanges 140 in the side walls of the upper housing 121 and into holes 148 provided in respective ones of the side pieces 132 and 134 of the end closure 128 so as to maintain those various components in their assembled configuration as shown in FIGS. 5 and 6. To maintain the end closures 128 in their correct relative rotational positions, the side pieces 132 and 134 thereof normally have tongues lanced therefrom as indicated at 150 for mating engagement with depressions 152 correspondingly formed in the side walls 124 and 126 of the upper housing 121.

The upper housing 121 of the light fixture 14 is completed by a cover plate 154 which is secured to the end base plates 136 of the end closures 128 by screws 156. Along each of its side edges, the cover plate 154 is formed with upwardly open channels 158 for receiving downwardly projecting lips 160 formed along the top edges of side walls 162 and 164 of an integrally formed transparent plastic lens generally indicated at 166 also including a base 168. Slots 147 are formed in the cover plate 154 for receiving the handle portions 145 depending below plate 154.

It will be understood that the lighting fixture 14 will internally be of conventional construction and, for example, will generally include a ballast 170 which will be properly connected to the sockets 139 and to an electrical cord 172 terminating in a conventional electrical plug 174 which can be inserted into a conventional electrical outlet receptacle.

Having described the construction of the lighting fixture 14, the manner in which that fixture is removably mounted in the module 12 in accordance with this invention will now be explained. For such installation, the arms 144 on the fixture 14 are retracted into the position shown in phantom and indicated at **144*a* in FIG. 6. The upper housing 121 of the fixture 14 is then inserted upwardly through the opening between the upstanding flanges 120 in the top wall 106 of the module 12. The handle portions 145 are then moved longitudinally relative to the upper housing 121 so as to extend arms 144 longitudinally end-wise therefrom and to be supported on the top surface of the top wall 106 of the module 12**.

Referring again to FIG. 3, it will be seen that there is shown therein somewhat schematically at 176 a plenum (omitted from FIG. 2) which is supplied with air by a duct 178. The plenum 176 includes walls 180 which extend downwardly between the upstanding flanges 22 and 36 of the extrusion **20*a* so that the air from that plenum can flow through the opening 48 into the space below the ceiling structure 10. Since the plenum 176 itself forms no part of this invention, its construction will not be described in greater detail herein. It should, however, be understood that, while it has been described as being utilized for the supply of air, it can equally be used for the supply of cooled or untreated air or for the extraction of air from the space below the ceiling structure 10**.

Having completed the description herein of the construction of the ceiling structure 10, the manner in which the structure is assembled and erected will now be reviewed.

For such assembly, the modules 12 are first individually assembled by first interconnecting the frame extrusions **20*a*, 20*b*, 20*c* and 20*d* using the L-shaped corner pieces 34 and 62. The side walls 96 and the top wall 106 are then fastened to the corner posts 64 by the rivets 104 and 110. Finally, the screws 78** are used to connect the corner posts to the module frame.

The top walls 106 of the modules will have been cut away to receive the lighting fixtures which will be fitted into the modules later.

Having completed the assembly of the modules 12, those modules are then suspended using the hanger wires 92 which are suitably anchored at their upper ends. The heights of the modules 12 may then be adjusted by turning the nuts 90 on the eye-bolts 82. Such height adjustment is usefully carried out by aligning the lower edges of the modules with a laser beam projected across the room in which the ceiling is being installed. The lighting fixtures are then inserted in the manner described above.

During such installation, the plugs 174 on the cords 172 from the lighting fixtures 14 will be inserted into appropriate receptacles (not shown) and the air-flow ductwork and plena will be connnected to the modules 12 in the manner already described and in the desired positions. Where the openings 48 are not to be used for air flow, those openings 48 can be concealed by the use of the decorator strips 47 as already explained.

Installation of the ceiling structure 10 is completed by installing the strips or panels 16. Such panel installation is effected by upwardly inserting those panels between the modules and allowing the lips 116 to hook over the top edges of the lips 52 of the module frames in the position shown in FIG. 3.

Having completed the description herein of the installation of the ceiling structure 10, some of the important practical advantages presented by that structure will now be considered.

One very important advantage of the ceiling structure 10 results from the ready removability of the lighting fixtures 14. In the event that one of those lighting fixtures 14 needs to be removed for repair or any other reason, it is a very simple matter to remove it from its module 12. Such removal is effected simply by first removing the lens 166 by flexing its side walls 162 and 164 outwardly to permit the lips 160 to be withdrawn from the channels 158.

The handle portions 145 of the arms 144 at the ends of the lighting fixture 14 are then moved inwardly so as to retract those arms and to allow the upper housing 121 to be lowered through the opening in the top wall 106. The cord plug 174 can then be unplugged from its receptacle. If desired, a replacement lighting fixture 14 can be installed in the reverse manner. It is to be noted that all these operations can be carried out by relatively unskilled labour since no connection and disconnection of individual wires is required.

A further important advantage of the ceiling structure hereinbefore described results from the provision of individual vertical adjustment members in the form of the eye-bolts 82 for each of the modules 12. After installation of the ceiling structure 10, settling of the building structure and/or stretching of the hanger wires 92 may necessitate re-levelling of the ceiling structure. Such re-levelling is a relatively simple matter with these novel ceiling structures.

Figure 8:
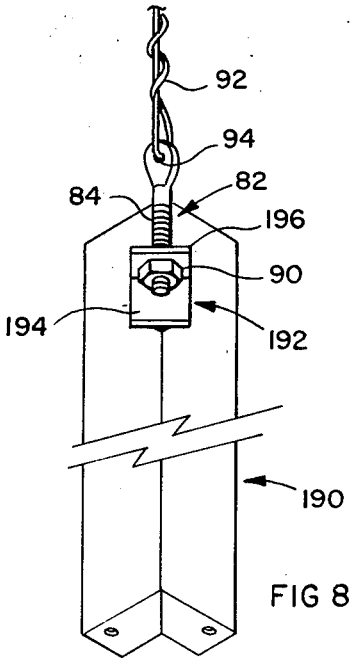
FIG. 8 is a perspective view showing an alternative construction for the corner post of the module shown in FIGS. 2, 3 and 4.

An alternative construction for the corner post of a ceiling module is shown in FIG. 8. The corner post generally indicated at 190 in that figure is generally similar to the post 64 already described herein and differs from the post only in the provision of an angle bracket generally indicated at 192 and including a vertical flange 194 secured, for example, by welding (not shown) to the post 190 and a horizontal flange 196 provided with a hole for receiving the shaft 84 of the eye-bolt 82 as will readily be understood from the drawing.

It will also be readily understood that one or more lighting fixtures 14 can be installed in each of the modules 12. Alternatively, some of the module can be left without any lighting fixtures. Additionally, each of the lighting fixtures can be of the single tube or multi-tube type.

Figure 14:
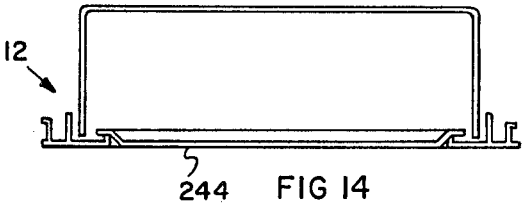
FIG. 14 schematically shows the alternative provision of an opaque panel in the ceiling module of FIGS. 2, 3 and 4.

If desired, a planar lens as indicated fragmentarily and in phantom outline by the legend 182 in FIG. 3 can be provided to provide a different ceiling appearance. Yet another possibility is to provide, instead of the lens 182, an opaque panel 244 in a module 12 as shown in FIG. 14 when no lighting fixture is provided in that module. It is equally possible to provide a lens 182 which has both transparent and opaque portions so as effectively to provide indirect lighting. Yet another possibility when no lighting fixture is to be provided is to use a removable panel to close the opening formed in the top wall 106 of the module 12. Instead of using a planar panel for such purpose, it is also possible to close such an opening with a pan-like structure containing a sound-absorbing batt.

While the ceiling structure 10 is shown in FIGS. 1 to 7 of the accompany drawings as being provided with fluorescent tube lighting fixture 14, it is equally within the scope of this invention to provide such a ceiling structure with lighting fixtures of other types. Some possible alternative arrangements will now be described with reference to the somewhat schematic illustrations of FIGS. 9 to 13 of the accompanying drawings.

Figure 9:
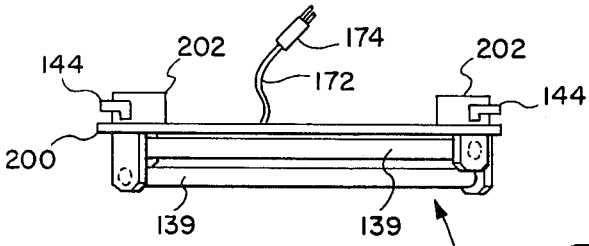
FIGS. 9 to 13 shown somewhat schematically alternative arrangements for providing lighting fixtures in the ceiling modules.

The lighting fixture generally indicated at 198 in FIG. 9 comprises a mounting plate 200 below which there are supported two mutually angularly oriented fluorescent tubes 139. The fixture 198 can be removably fitted in the manner already described into an opening in the top wall 106 of a module 12 by means of pairs of retractable arms 144 provided on upstanding flanges 202 at each end of the fixture.

Figure 10:
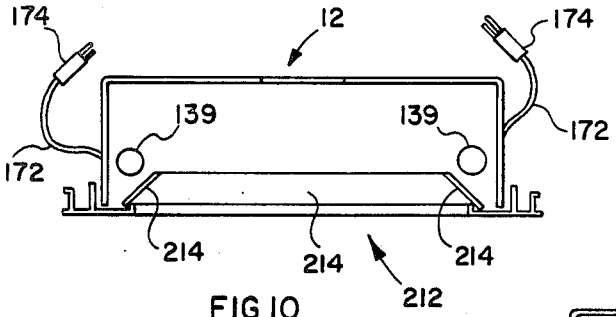

The module structure generally indicated at 212 in FIG. 10 is somewhat different in that the fluorescent tubes 139 are supported in sockets (not shown) provided on opposed side walls of the module 12 so that such tubes then extend generally along the other two side walls of the module. Inwardly and upwardly sloping strips 214 provide a mask to conceal the tubes and to provide a concealed lighting module. Such strips 214 can be permanently or removably attached to the module 12.

Figure 11:
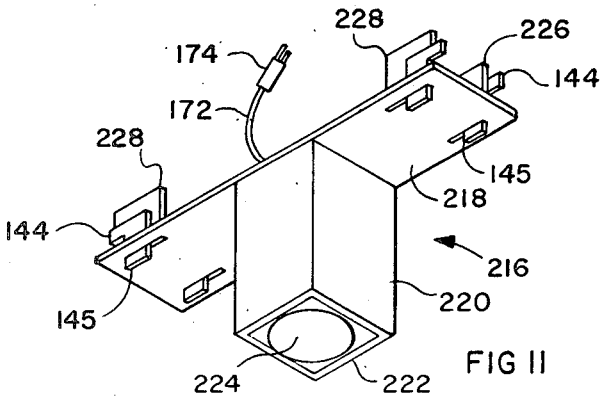

Referring next to FIG. 11, it will be seen that there is shown therein generally at 216 a lighting fixture comprising a mounting plate 218 having depending therefrom a lamp housing including side walls 220 and a bottom wall 222 provided with an opening 224. The fixture 216 is formed on top of its mounting plate 218 at each of its ends with two upstanding flanges 226 and 228 carrying retractable arms 144 for removably securing the fixture in a module 12 in the manner already described. If desired, a transparent lens can be fitted in the aforementioned opening 224.

Figure 12:
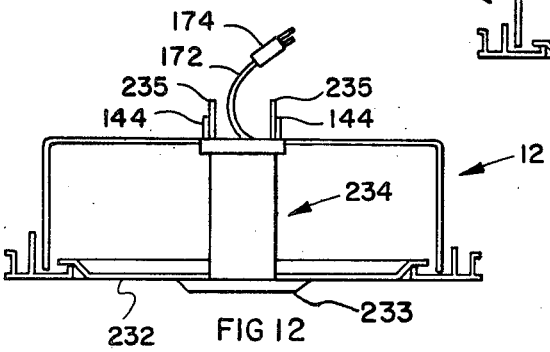

FIG. 12 shows generally at 234 a lighting fixture which is generally similar to the fixture 216 but includes side walls 235 which extend downwardly through a panel 232 supported at the base of the module 12. An elongated lens 233 closes the lower end of the fixture which is removably fitted in the module 12 in the manner already described.

Figure 13:
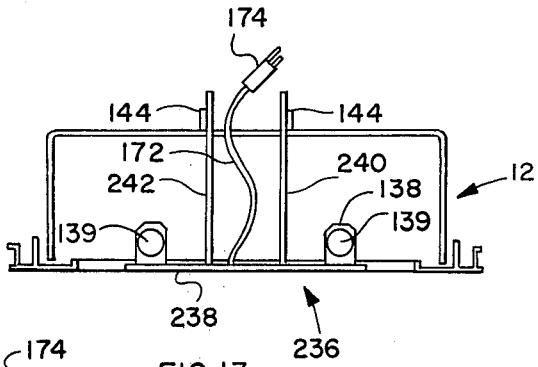

Finally, reference will be made to FIG. 13 which shows generally at 236 yet another indirect lighting fixture. That fixture includes an opaque base plate 238 formed with elongated upstanding flanges 240 and 242 carrying the retractable arms 144 for removably fitting the fixture in a module 12. Fluorescent tubes 139 are mounted above the top surface of the base plate 238 outwardly of the flanges 240 and 242.

All of the lighting fixtures shown in FIGS. 9 and 11 to 13 as well as the module structure 212 shown in FIG. 10 are provided with electrical cords 172 and plugs 174 for the reasons already explained herein with reference to the lighting fixture shown in FIGS. 5, 6 and 7.

The foregoing is a description of a preferred embodiment of the invention which is given here by way of example only. The invention is not to be taken as limited to any of the specific features as described, but comprehends all such variations thereof as come within the scope of the appended claims.

The embodiments of the invention in which an exclusive property or privilege is claimed are defined as follow:

1. A lighting fixture for a ceiling structure including mutually parallel and spaced apart ceiling members having upwardly facing surfaces defining an opening and wherein a said lighting fixture may be removably positioned between said ceiling members and supported in such position, said lighting fixture comprising a generally rectangular housing having mutually spaced apart side walls, and a bottom wall releaseably attached thereto;

arms retractably mounted on said side walls for movement between extended positions for disposition on said upwardly facing surfaces of said ceiling members and retracted positions so that said lighting fixture can be moved vertically between said ceiling members, and, a handle portion projecting downwardly from each said arm and extending below said bottom wall.

2. A lighting fixture as claimed in claim 1 and which additionally comprises frictional engagement means for frictionally restricting movement of said arms relative to said side walls of said housing.

3. A lighting fixture as claimed in claim 2 and in which each said frictional engagement means comprises a resilient flange formed on a respective one of said side walls and projecting through an elongated slot formed in a respective one of said arms and frictionally engaging that arm.

4. A lighting fixture as claimed in claim 1 including two said arms retractably mounted on each said side wall at each end thereof.

5. A lighting fixture as claimed in claim 4 and in which said lighting fixture includes at least one lamp mounted downwardly of said bottom wall and a lens partially encircling said lamp.

6. A lighting fixture as claimed in claim 5 wherein said generally rectangular housing includes end walls.

7. A lighting fixture as claimed in claim 6 including slotted openings formed in said side walls, flange means along opposite sides of said slotted openings, and said arms including slotted openings therein, with said flange means of said side walls extending therethrough in guiding relation.

8. A lighting fixture as claimed in claim 1 wherein said generally rectangular housing comprises a top wall, side walls, end walls and a bottom wall releaseably attached thereto, defining an enclosure for portions of said lighting fixture;

lighting element connection means extending downwardly from said bottom wall for releaseably mounting lighting elements therebeneath;

said rectangular housing being of predetermined width, adapted to be removably positioned between said ceiling members as aforesaid, and said bottom wall having a width greater than said predetermined width whereby to close off said opening, when said lighting fixture is positioned between said ceiling members as aforesaid.

9. A lighting fixture as claimed in claim 8 including openings formed in said bottom wall, and said handle portions extending downwardly through said openings.

10. A lighting fixture as claimed in claim 9 including lens attachment formations formed on opposite side edges of said bottom wall, and partially surrounding said handle portions, and including lens means releaseably attachable to said formations, substantially concealing said lighting elements and said handles.

11. A lighting fixture for a ceiling structure including mutually parallel and spaced apart ceiling members having upwardly facing surfaces defining an opening and wherein a said lighting fixture comprising a generally rectangular housing having a top wall, side walls, end walls and a bottom wall releaseably attached thereto, defining an enclosure for portions of said lighting fixture;

lighting element connection means extending downwardly from said bottom wall for releaseably mounting lighting elements therebeneath;

four retractable arm members for removeably supporting said lighting fixtures in said opening, one said arm member being located adjacent each corner of said housing and lying on the exterior surfaces of the side walls;

guide means on said side walls exteriorly thereof for interengaging with said arm members and guiding same for linear reciprocal movement;

handle means connected to said arms for manual operation thereof, said handle means extending downwardly below said housing, and, lens means releaseably attachable to said housing and extending downwardly therefrom around said lighting element connection means and said handle means.

12. A lighting fixture as claimed in claim 11 wherein each said arm member comprises a flat planar member, a slotted opening formed therein, along the axis of said linear movement, and said handle being formed integrally therewith and projecting normal to said axis.

13. A lighting fixture as claimed in claim 12 wherein said guide means comprise pairs of flanges extending outwardly from said side walls, and fitting in respective said slotted openings, and fastening means extending through said slotted openings, and between said pairs of flanges, securing said arm member in position.

* * * * *